US008366098B2

(12) United States Patent
Kobayashi

(10) Patent No.: US 8,366,098 B2
(45) Date of Patent: Feb. 5, 2013

(54) MEDIUM STORAGE DEVICE, IMAGE FORMING DEVICE AND MEDIUM STORAGE SYSTEM

(75) Inventor: Takashi Kobayashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 13/224,978

(22) Filed: Sep. 2, 2011

(65) Prior Publication Data

US 2012/0056370 A1 Mar. 8, 2012

(30) Foreign Application Priority Data

Sep. 6, 2010 (JP) ..... 2010-198565

(51) Int. Cl.
*B65H 1/00* (2006.01)

(52) U.S. Cl. ..... 271/171; 271/145

(58) Field of Classification Search ..... 271/393, 271/164, 145, 171; 399/393
See application file for complete search history.

(56) References Cited

U.S. PATENT DOCUMENTS

| | | | | |
|---|---|---|---|---|
| 4,444,386 | A * | 4/1984 | Murata et al. | 271/127 |
| 5,765,091 | A * | 6/1998 | Kovach et al. | 399/393 |
| 5,769,409 | A * | 6/1998 | Nakamatsu et al. | 271/171 |
| 7,527,259 | B2 * | 5/2009 | Meetze et al. | 271/171 |
| 7,668,502 | B2 * | 2/2010 | Park | 399/393 |
| 7,946,575 | B2 * | 5/2011 | Kim et al. | 271/171 |
| 2004/0169327 | A1 * | 9/2004 | Swayze et al. | 271/145 |
| 2012/0205859 | A1 * | 8/2012 | Nishioka | 271/145 |

FOREIGN PATENT DOCUMENTS

JP A-H08-073058 3/1996

* cited by examiner

*Primary Examiner* — Jeremy R Severson
(74) *Attorney, Agent, or Firm* — Posz Law Group, PLC

(57) ABSTRACT

A medium storage device that is covered by a dust cover and that stores a recording medium, includes: a guide member that is extendably and retractably provided in the medium storage device and that restricts a position of an edge part of the recording medium; and a lock member that locks the guide member and that releases the lock status of the guide member when the lock member moves in a first direction so as to allow the guide member to extend and retract, wherein the movement of the lock member in the first direction is restricted by the dust cover so that the guide member is stably locked.

18 Claims, 16 Drawing Sheets

MEDIUM STORAGE DEVICE, IMAGE FORMING DEVICE AND MEDIUM STORAGE SYSTEM

CROSS REFERENCE TO RELATED APPLICATION

The present application is related to, claims priority from and incorporates by reference Japanese patent application No. 2010-198565, filed on Sep. 6, 2010.

TECHNICAL FIELD

The present application relates to a medium storage device, an image forming device and medium storage system. In particular, the present application relates a removable medium storage device, a dust cover for the medium storage device, and an image forming device that mounts the medium storage device and the dust cover.

BACKGROUND

A technology is conventionally known in the medium storage device, dust cover and image forming device, that a retractable extension part is provided in the removable medium storage device to store sheets that are larger than a footprint of the image forming device.

Japanese Laid-Open Patent Application No. H8-73058 describes a technology relating to an image forming device, in which a dust cover that is slidable in an installation/removal direction of a sheet cassette, which is a medium storage device, is provided above a sheet cassette exit opening and covers an opening of the sheet cassette in association with installation and removal of the sheet cassette.

SUMMARY

However, there is the below problem in the conventional medium storage device, dust cover and image forming device.

Because a retractable extension part is provided in the sheet cassette that is the medium storage device, when the number of sheets set in the sheet cassette is low, the extension part of the sheet cassette, rather than the dust cover, slides. As a result, the set recording sheets may be scratched or folded, causing occurrence of jam at the time of carrying the sheets.

A medium storage device disclosed in the application that is covered by a dust cover and that stores a recording medium, includes: a guide member that is extendably and retractably provided in the medium storage device and that restricts a position of an edge part of the recording medium; and a lock member that locks the guide member and that releases the lock status of the guide member when the lock member moves in a first direction so as to allow the guide member to extend and retract, wherein the movement of the lock member in the first direction is restricted by the dust cover so that the guide member is stably locked.

A medium storage system disclosed in the application includes: a medium storage device that stores a recording medium, the medium storage device including a guide member that is extendable and retractable in accordance with the size of the recording medium, and that guides a longitudinal edge part of the recording medium, and a lock member that moves together with the guide member, and that is slightly movable in order to take two positions: one for locking the guide member, the other for unlocking the guide member; and a dust cover that is attached to the guide member in order to move together with the guide member and that covers a top surface of the medium storage device, the dust cover including an abutment member that abuts with the lock member such that the position of the lock member remains locked while the dust cover is attached.

An image forming device disclosed in the application includes the dust cover and the medium storage device.

According to the medium storage device, dust cover and image forming device of the present application, a scratch and fold that occurs at an edge part of the recording medium is prevented.

DETAILED DESCRIPTION OF EMBODIMENTS

Detailed description of embodiments becomes apparent when read in light of the explanation of preferred embodiments and accompanied drawings. However, the drawings are for the explanation purpose only and are not intended to limit the scope of the invention.

Figure 1:
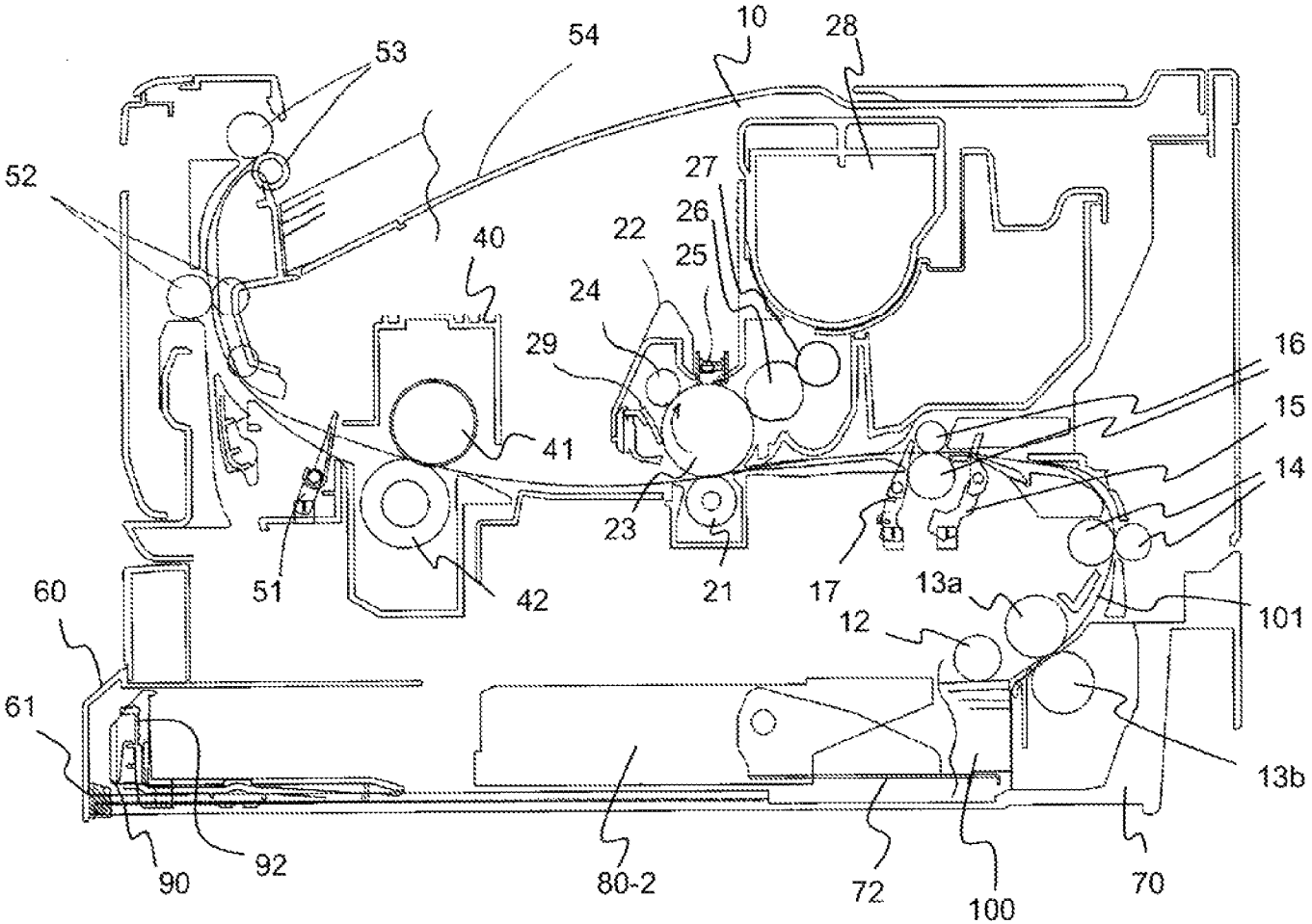
FIG. 1 is a schematic structural diagram illustrating an image forming device according to a first embodiment of the present application.

First Embodiment (Structure of First Embodiment) FIG. 1 is a schematic structural diagram illustrating an image forming device according to a first embodiment of the present application.

An image forming device 10, which is an electrographic printer, includes a sheet cassette 70 that is a medium storage device that stores recording medium (e.g., recording sheets)

100, a sheet supply roller 12 that supplies the recording sheets 100, a separation roller 13*a* for separating the recording sheets 100, carrying rollers 14 and registration rollers 16 for carrying the recording sheets 100 to a carrying path 101, and an entrance sensor 15 and a passage sensor 17 for detecting positions of the sheets. The image forming device 10 includes an image forming part that forms a toner image, which is a developer image, on the recording sheets 100, a fuser 40, which is a fusion member, that fixes the toner image on the recording sheets 100 by supplying heat, a sheet ejection mechanism that ejects the recording sheets 100, and an ejection stacker 54 that stores the ejected recording sheets 100. In addition, the image forming device 10 includes motors (not shown) for rotating each roller, a clutch that turns on and off transmission of motive force to rollers of the carrying path 101, a high voltage power source that supplies a high voltage of 200 V to 5000 V to a charge roller 24 and a transfer roller 21 in the image forming part, and a low voltage power source that supplies 5 V direct current or 24 V direct current to circuits and motors.

A sheet supply part includes the sheet cassette 70 installed in a lower part of the image forming device 10, the recording sheets 100 stored in the sheet cassette 70, and the sheet supply roller 12 and the separation roller 13*a* for separating and taking out recording sheet 100 sheet by sheet from the sheet cassette 70.

The sheet cassette 70 is a cassette that stores a plurality of recording sheets 100 and is removably mounted on a lower part of the image forming device 10. The sheet cassette 70 includes a retard roller 13*b* that faces and rotates in accordance with the separation roller 13*a*, an stacker plate 72 that installs the recording sheets 100 thereon, left and right side guides (80-1, 80-2) that each restrict positions of edge parts of the recording medium 100 in a width direction, a tail guide 90 that is a extendable guide member that restricts of the position of the edge of the recording sheet 100 in a length direction, and a lock lever 92 that is a lock member that locks the tail guide 90. The tail guide 90 side of the sheet cassette 70 is covered by a dust cover 60 provided at a rear edge of the image forming device 10. An abutment rib 61, which is an abutment member that abuts with a lock lever 92, is provided at a lower part of the dust cover 60.

The recording sheet 100 may be bond paper, recycled paper, gloss paper, matte paper, over-head-projector (OHP) films or the like.

The sheet supply roller 12 presses against, and rotates on, the recording sheet 100. The separation roller 13*a* and the retard roller 13*b* are arranged on the downstream side of the sheet supply roller 12 in the carrying path 101 and face each other so as to sandwich the recording sheet 100.

The carrying rollers 14 are arranged on the downstream side of the sheet supply mechanism in the carrying path 101 and face each other so as to sandwich the recording sheet 100. The carrying rollers 14 are driven by a motor (not shown).

The sheet entrance sensor 15 is arranged on the downstream side of the carrying rollers 14 in the carrying path 101 and detects the carrying of the recording sheet 100.

The registration rollers 16 are arranged on the downstream side of the entrance sensor 15 in the carrying path 101 and face each other so as to sandwich the recording sheet 101. The registration rollers 16 are driven by a registration motor (not shown).

The passage sensor 17 is arranged on the downstream side of the registration rollers 16 in the carrying path 101 and detects the carrying of the recording sheet 100.

The image forming part can be divided into a transfer roller 21, an image drum unit 22 and an exposure head 25 that is mounted on the image drum unit 22 and functions as an exposure device that irradiates light that corresponds to image information to a surface of a photosensitive body (e.g., photosensitive drum 23, or photosensitive belt). In addition, the image drum unit 22 can be divided into a developer container (hereinafter, referred to as "toner cartridge") 28 positioned on the upper part of the image forming part and an image drum unit 22 main body positioned on a lower part of the image forming part.

The image drum unit 22 includes the photosensitive drum 23 that carries an electrostatic latent image based on image information, a charging roller 24 as a charging member that charges the photosensitive drum 23, a development roller 26 as a developer carrier that develops the electrostatic latent image on the surface of the photosensitive drum 23 with toner as a developer, a supply member and a supply roller 27 that supply the toner to the development roller 26, a development blade (not shown), and a cleaning device 29 that scraps off the toner that remains on the photosensitive drum 23. The image forming part includes a development means that develops the toner image, for example, onto the recording sheet 100.

The photosensitive drum 23 includes a photoconductive layer and a charge transportation layer on a conductive base layer that is formed from aluminum or the like. The photosensitive drum 23 is in a cylindrical shape and is arranged to be rotatably supported. The photosensitive drum 23 is in contact with the charging roller 24, the transfer roller 21, and the development roller 26 and is arranged so that a tip end of the cleaning device 29 contacts the photosensitive drum 23. The photosensitive drum 23 functions as an image carrier that carries the toner image by holding charges on the surface of the photosensitive drum 23 and rotates in the direction indicated by an arrow in the drawing. A configuration of the image forming part is described below based on the order in the rotational direction of the photosensitive drum 23. The shape of photosensitive body is not limited to cylindrical. Longitudinal oval shape is, for example, practical.

In the charging roller 24, a conductive metal shaft is coated by a semi-conductive rubber, such as silicone or the like. The charging roller 24 is in a cylindrical shape and is arranged to be pressed against the photosensitive drum 23 and rotatably supported. The charging roller 24 is charged by a power source (not shown) and applies a predetermined voltage to the photosensitive drum 23 by rotating while being pressed against the photosensitive drum 23. Thereby, the surface of the photosensitive drum 23 is uniformly charged.

The exposure head 25 is configured from a plurality of light emitting diodes (hereinafter, referred to as LED), a lens array and an LED drive element. The exposure head 25 is arranged above the photosensitive drum 23 as shown in FIG. 1. The exposure head 25 irradiates light that corresponds to image information onto the surface of the photosensitive drum 23 and forms the electrostatic latent image on the surface of the photosensitive drum 23.

The supply roller 27 is formed by covering a conductive metal shaft with resin or the like. The supply roller 27 is in a cylindrical shape and is arranged to contact the development roller 26. A voltage is applied to the supply roller 27 from a power source (not shown), and by being pressed against the development roller 26, the toner is supplied to the development roller 26.

In the development roller 26, a conductive metal shaft is coated by a semi-conductive urethane rubber material or the like. The development roller 26 is in a cylindrical shape and contacts the supply roller 27 and the photosensitive drum 23. The development roller 26 is arranged such that the tip end of the development blade contacts the development roller 26. A voltage is applied to the development roller 26 from a power source (not shown). The development roller 26 supplies the toner on the surface of the photosensitive drum 23 by contacting the supply roller 27 and rotating. By contacting the photosensitive drum 23 and rotating, the development roller 26 attaches the toner to the electrostatic latent image formed on the surface of the photosensitive drum 23 and forms a toner image. In other words, the development roller 26 develops the electrostatic latent image on the surface of the photosensitive drum 23.

The development blade (not shown) as a developer layer restriction member is formed by stainless steel or the like. The development blade is in a plate shape and is arranged such that the tip end contacts the surface of the development roller 26. The development blade restricts the thickness of toner formed on the surface of the development roller 26 to become always uniform by scraping the excess toner on the surface of the development roller 26.

The cleaning device 29 as a cleaning member is formed by a rubber material or the like. The cleaning device 29 is in a plate shape and is arranged such that the tip end contacts the surface of the photosensitive drum 23. The cleaning device 29 cleans the photosensitive drum by scraping off the toner remaining on the photosensitive drum 23 after the toner image formed on the photosensitive drum 23 is transferred onto the recording sheet 100.

The fuser 40 includes a heat roller 41 and a backup roller 42. The fuser 40 is a fusion member that fuses the toner image by pressing and heating the recording sheet 100.

The sheet ejection mechanism includes an ejection sensor 51, ejection rollers 52 and ejection rollers 53. The ejection rollers 52 and the ejection rollers 53 are arranged on the downstream side of the fuser 40 in the carrying path 101 to respectively face each other so as to sandwich the recording sheet 100. The ejection rollers 52 and the ejection rollers 53 are respectively driven by a motor (not shown).

Figure 2:
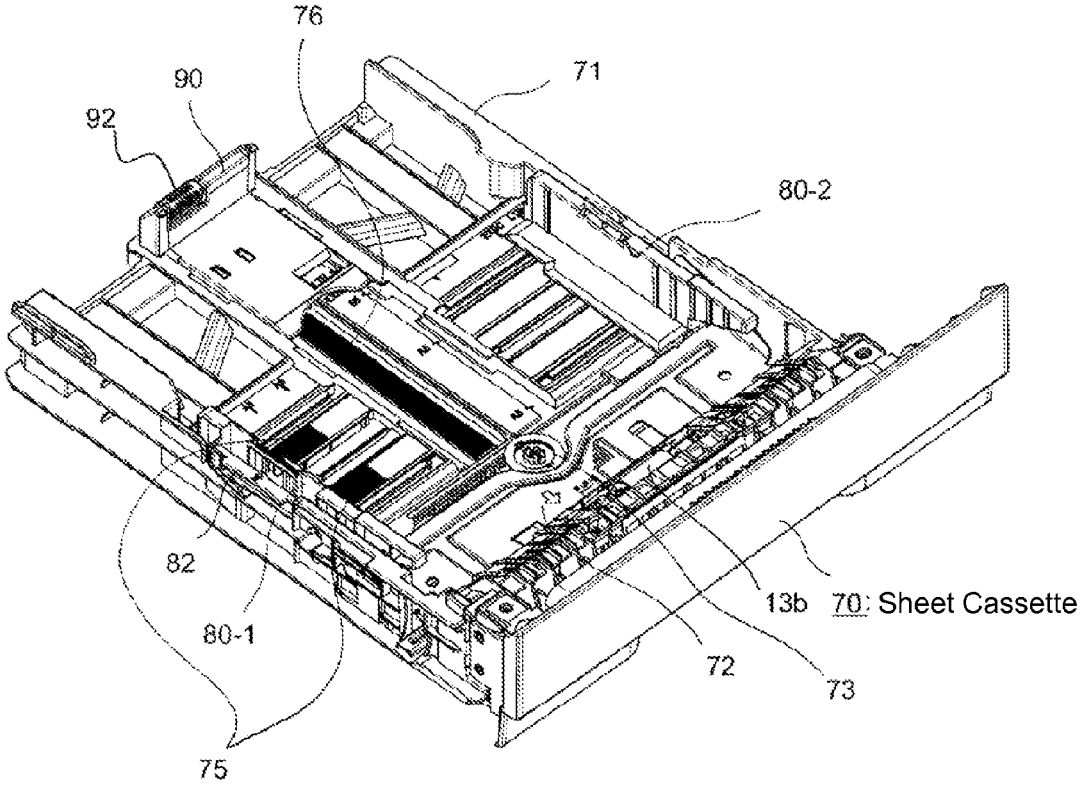
FIG. 2 is a perspective view of a sheet cassette in FIG. 1.

FIG. 2 is a perspective view of the sheet cassette in FIG. 1. The sheet cassette 70 that is removable from the printer main body includes a cassette frame 71 for storing the recording sheets 100, the stacker plate 72 for pressing the recording sheets 100 against the sheet supply roller 12, and the retard roller 13*b* for separating the recording sheets 100.

The cassette frame 71 includes a left side guide 80-1 and a right side guide 80-2 as sheet guides for setting the recording sheets 10, and a pinion gear 73 in the center part that interlocks the left side guide 80-1 and the right side guide 80-2. On the slightly left side of the center of the cassette frame 71 as shown in FIG. 2, a groove 75 is provided. A lock lever 82 is provided on the left side guide 81-1. Based on the operation of the lock lever 82, a claw part 83 which is provided on the left side guide 80-1 as described below and shown in FIG. 4 engages with, and disengages from, the groove 75 provided on the cassette frame 71. As a result, the left side guide 80-1 and the right side guide 80-2 are locked to, and unlocked from, the cassette frame 71.

Moreover, the cassette frame 71 includes a tail guide 90 on the rear side of the cassette frame 71 as a sheet guide for setting the recording sheets 100. On the cassette frame 71, a groove 76 is provided as a first engagement part. Based on the operation of the lock lever 92, a claw part 93 as a second engagement part, which is provided on the tail guide 90 as described below and shown in FIG. 6, engages with, and disengages from, the groove 76 provided on the cassette frame 71. As a result, the tail guide 90 is locked to, and unlocked from, the cassette frame 71.

Figure 3A:
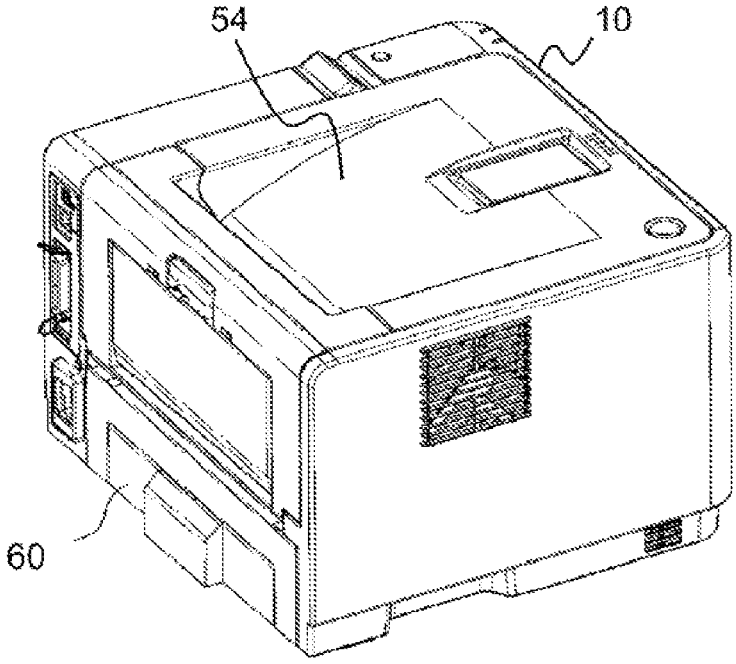
FIGS. 3A and 3B are perspective views of the image forming device in FIG. 1.
Figure 3B:
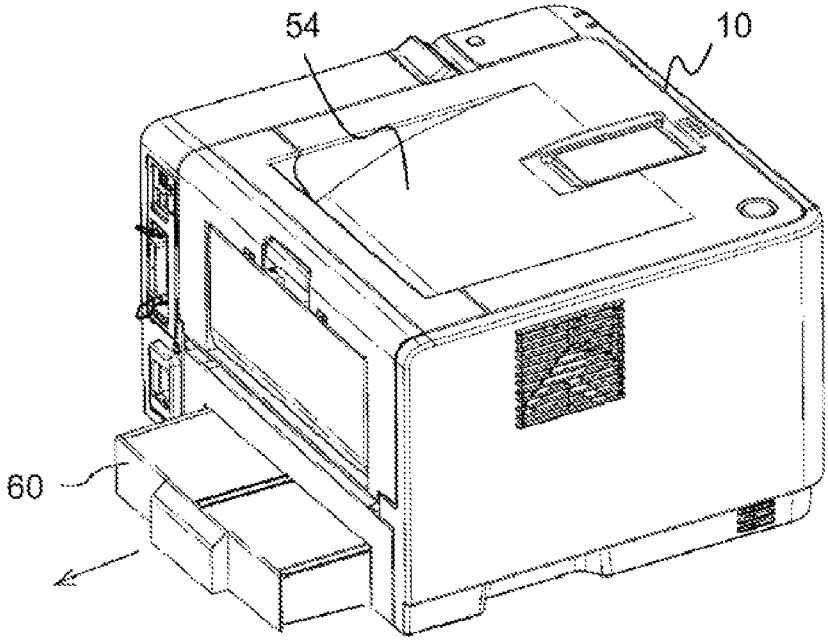

FIGS. 3A and 3B are perspective views of the image forming device shown in FIG. 1. FIG. 3A illustrates a state in which the tail guide 90 is retracted, and FIG. 3B illustrates a state in which the tail guide 90 is extended out of the image forming device.

The image forming device 10 includes an ejection stacker 54 that is provided on the top surface diagonally upwardly towards a front surface side of the image forming device 10 and a dust cover 60 that is provided on the rear lower part of the image forming device 10 and that covers the rear surface of the sheet cassette 70.

As shown in FIG. 3A, the dust cover 60 is normally a part of a housing cover of the image forming device 10 main body. In the image forming device 10 that is used in offices and the like, the sheet cassette 70 that stores the recording sheets 100 to be used is often of the removable type.

With the advancement in compact design in recent years, the device size of the image forming device 10 is reduced year by year, and today there is an image forming device 10 which footprint area is smaller than the size of recording sheets 100. The sheet cassette 70 of such a compact image forming device 10 is made capable of storing the recording sheets 100 that is larger than the footprint area by providing the tail guide 90 that is a retractable extension part.

The tail guide 90 is configured to be extendable and retractable with respect to the sheet cassette 70 in a longitudinal direction of the sheet (or insertion direction of the sheet cassette 70). Because a part the sheet cassette 70 that is extended by the tail guide 90 projects from the image forming device 10 main body and creates an opening, foreign materials, such as dust and the like, likely enter from the opening. When the foreign materials enter into the sheet cassette 70, misfeed is caused during the sheet supply, and unfavorable effects, such as decrease in image quality and the like, occur during the image formation. Thereby, troubles in the image forming device 10 main body are eventually caused.

Therefore, as shown in FIG. 3B, when the recording sheets 100 with a size that exceeds the footprint area of the image forming device 10 is stored in the sheet cassette 70, the dust cover 60 has a mechanism that is capable of slide movement from the image forming device 10 main body in the arrow direction and includes a top surface part (or first surface) that covers the top surface of the sheet cassette 70 and a rear surface part 602 (second surface) to cover a rear surface of the sheet cassette 70. See FIG. 10. This is to cover the sheet cassette 70 freely extendably in accordance of extension of the sheet cassette 70.

The dust cover 60 moves in accordance with the movement of the tail guide 90. Thereby, even when various sizes of sheets are inserted in the sheet cassette 70, the rear edge part of the sheet is covered. The shape and material of the dust cover is not particular limited so long as the operation and function of the below-described dust cover are satisfied. In the embodiment, the top surface part 601 of the dust cover 60 is formed with a solid plate. However, it is practical to form it with an expandable/retractable materials or structures. For example, accordion type structure and rubber type materials may be used. In the invention, the dust cover functions to cover the top surface of the recoding sheet. It is not necessary to completely veil the surface. In view of preventing dust from coming into the record cassette, some apertures or inclines slits may be applied. Also, it is design matter whether or not to cover the side or rear side of the recording sheet.

(Operation of First Embodiment) Image forming operations of the image forming device 10 are described based on FIG. 1.

The recording sheet 100 is carried from the upstream side to the downstream side along the carrying path 101. The sheet cassette 70 is on the most upstream side, and the ejection stacker 54 is on the most downstream side.

The image forming device 10 is connected to a host device though a cable or a wireless communication. When an instruction to print is received by receiving a transfer of print data from the host device, a pickup motor (not shown) rotates the sheet supply roller 12. A plurality of the recording sheets 100 is separated into each sheet and carried to the downstream side in the carrying path 101. The image forming part starts rotation of the rollers substantially at the same time as the commencement of the sheet supply. The photosensitive drum 23 is rotated for one or more turns until the recording sheet 100 reaches the photosensitive drum 23.

When the motor (not shown) rotates the separation roller 13*a*, the retard roller 13*b* that is in contact with the separation roller 13*a* is driven in accordance with rotation of the separation roller 13*a*. The recording sheet 100 carried from the sheet supply roller 12 is pinched and carried by the separation roller 13*a* and the retard roller 13*b* and is carried to the carrying roller 14 provided on the downstream side in the carrying path 101.

When the recording sheet 100 reaches the registration rollers 16, the recording sheet 100 is diagonally offset as each recording sheet 100 is separated by the sheet supply roller 12 and the separation roller 13*a*. The offset of the recording sheet 100 is corrected by striking the recording sheet 100 on the non-rotating registration rollers 16. After the striking, the position of the recording sheet 100 is detected by the entrance sensor 15, and the registration rollers 16 are rotated as the motive force is connected by a clutch.

The recording sheet 100 is carried to the image forming part provided on the downstream side in the carrying path 101 by the registration roller 16 that is rotated as the motive force is connected by a clutch.

When the recording sheet 100 causes the passage sensor 17 to turn on, the image drum unit 22 starts forming a toner image. The photosensitive drum 23 of the image forming device rotates in a clockwise direction in the drawing, and the surface of the photosensitive drum 23 is first uniformly charged by the charging roller 24. The exposure head 25 irradiates light to the uniformly charged photosensitive drum 23 based on the image information received from the host device to form an electrostatic latent image. The photosensitive drum 23 on which the electrostatic image has been formed develops a toner image by the supply roller 27 and the development roller 26. The photosensitive drum 23 on which the toner image has been formed pinches and carries the recording sheet 100 with the transfer roller 21 and transfers the toner image onto the recording sheet 100 by attracting toner on the photosensitive drum 23 to the recording sheet 100 side due to a voltage of +3,000 V applied to the transfer roller 21. The recording sheet 100 onto which the toner image has been transferred is sent to the fuser 40 where the toner image is fixed. The toner that remained on the photosensitive drum 23 is scraped off by the cleaning device 29.

The recording sheet 100 onto which the toner has been transferred is pinched by and carried through a nip region formed by the heat roller 41 and the backup roller 42 in the fusser 40. Heat from the heat roller 41 and pressure by a bias force of the backup roller 42 are added to the recording sheet 100 in the nip region. The toner image is fixed as the toner is fused.

Ejection of the recording sheet 100 on which the toner image has been fixed from the fuser 40 is detected by the ejection sensor 51 and is carried by the rotation of the ejection rollers 52 and the ejection rollers 53. The recording sheet 100 that is carried is ejected to the ejection stacker 54.

Operation of the sheet cassette 70 is described based on FIG. 2. When the recording sheets 100 are set in the sheet cassette 70 and when the sheet cassette 70 is installed in the printer main body, the sheets 100 are pressed against the sheet supply roller 12 by the stacker plate 72. As a result, of a plurality of the recording sheet 100 that has been set, the top recording sheet 100 is supplied. When two sheets are supplied at the same time by error, the lower recording sheet 100 is checked by the regard roller 13*b* on the sheet cassette 70 side so that the upper recording sheet 100 is carried by the separation roller 13*a*.

On the respective sides of the stacker plate 72, the left side guide 80-1 and the right side guide 80-2 are provided for guiding the recording sheets 100 in the width direction. On a rear part of the sheet cassette 70, the tail guide 90 is provided for guiding the recording sheet 100 in the length direction.

Figure 4A:
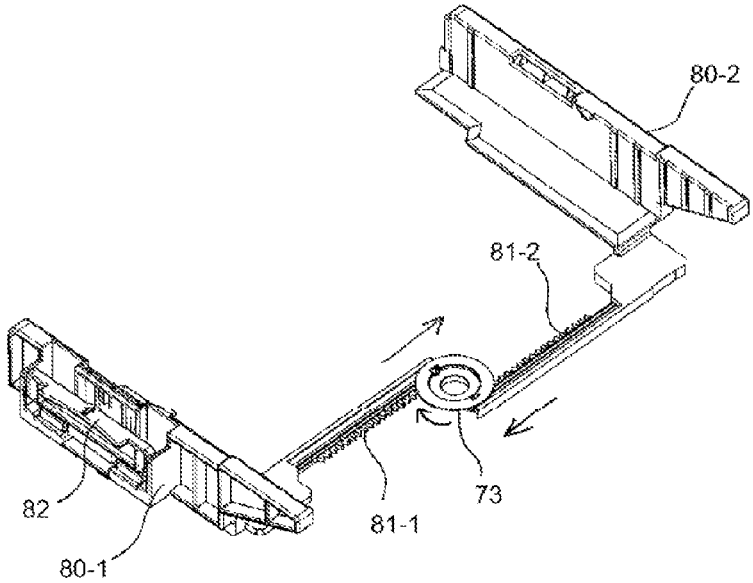
FIGS. 4A and 4B are perspective views of side guides and a pinion gear in FIG. 2.
Figure 4B:
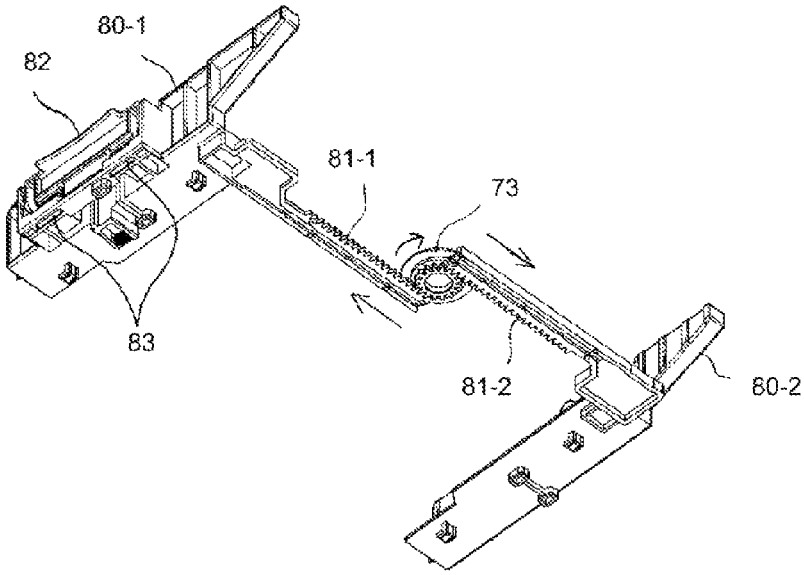

FIGS. 4A and 4B are perspective views of the side guides and the pinion gear shown in FIG. 2. FIG. 4A is a perspective view of the front side, and FIG. 4B is a perspective view of the back side.

The left side guide 80-1 includes a rack gear 81-1 provided in a direction perpendicular to a restriction surface that restricts the recording sheets 100. Similarly, the right side guide 80-2 includes a rack gear 81-2 provided in a direction perpendicular to a restriction surface that restricts the recording sheets 100. As shown in the above-described FIG. 2, the pinion gear 73 is arranged in the center part of the cassette frame 71, to which both of the rack gears 81-1 and 81-2 engage. The left side guide 80-1 and the right side guide 80-2 are configured to operate simultaneously in the arrow directions shown in FIG. 4A and in the arrow directions shown in FIG. 4B in accordance with the respective engagement of the rack gears 81-1 and 81-2 to the pinion gear 73.

In addition, the left side guide 80-1 includes the lock lever 82 and the claw part 83 that operates in conjunction with the lock lever 82. As shown in the above-described FIG. 2, the groove 75 to which the claw part 83 of the left side guide 80-1 engages is gravened in the cassette frame 71.

Figure 5A:
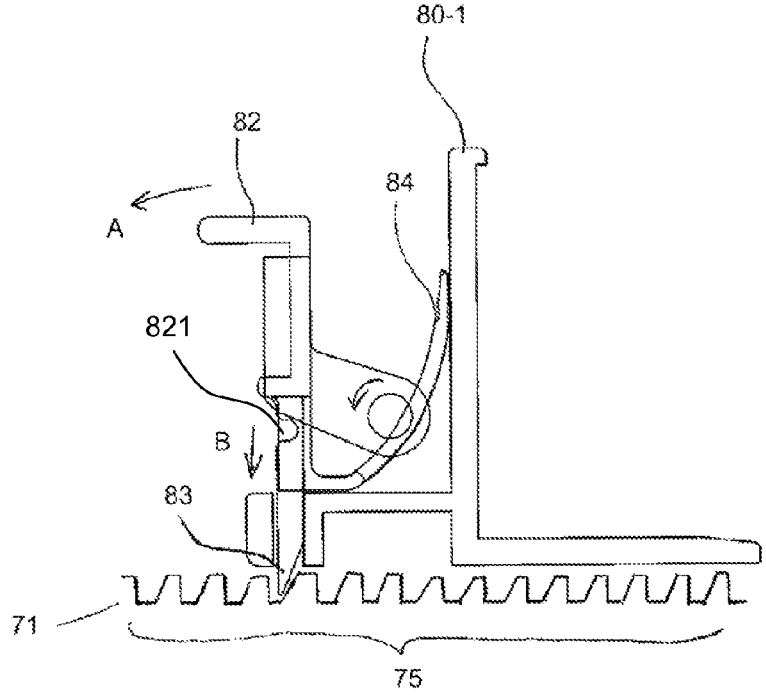
FIGS. 5A and 5B are cross-sectional views illustrating movement of the side guides and a lock lever in FIG. 2.
Figure 5B:
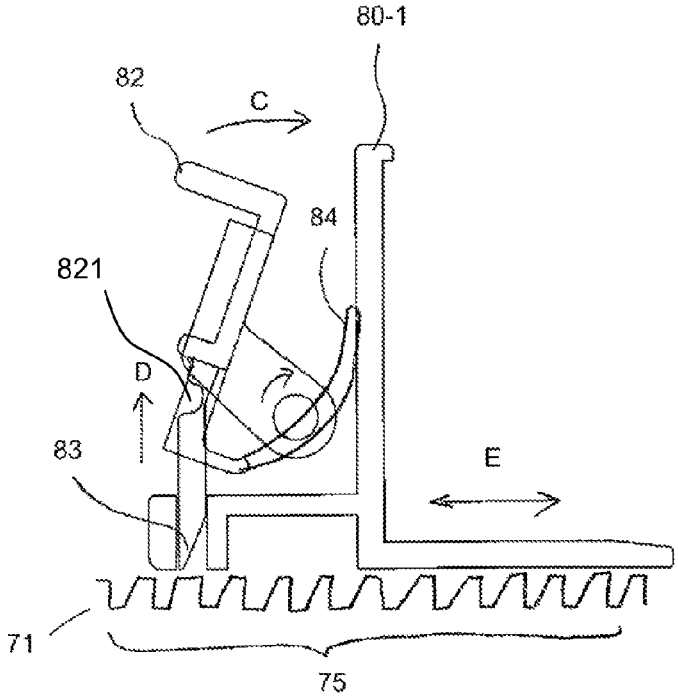

FIGS. 5A and 5B are cross-sectional views illustrating operation of the side guides and lock levers shown in FIG. 2. FIG. 5A illustrates the locked state, and FIG. 5B illustrates the unlocked state.

The left side guide 80-1 includes the lock lever 82 and the claw part 83 that are integrally formed, and a mold spring 84 which is an elastic body that is also integrally formed. The left side guide 80-1 is positioned above the groove 75 on the cassette frame 71 side, and the restriction surface of the left side guide 80-1 is positioned perpendicular to the groove 75. The lock lever 82, claw part 83 and mold spring 84 are attached slightly outside the restriction surface of the left side guide 80-1. In FIG. 5, the claw part 83 is engaged with the groove 75, and the lock lever 82 is arranged on the upper side of the claw part 83. The mold spring 84 is provided between the restriction surface of the left side guide 80-1 and the lock lever 82.

In FIG. 5A, the lock lever 82 is held in the direction of allow A due to bending stress of the mold spring 84. Because the claw part 83 moves in the direction of allow B at this time, the claw part 83 is engaged with the groove 75 on the cassette frame 71 side, and the left side guide 80-1 is locked on the cassette frame 71.

A situation is considered in FIG. 5B where the user rotates the lock lever 82 of the left side guide 80-1 in the direction of arrow C. The claw part 83 moves in the direction of arrow D at this time, and the engagement with the groove 75 is released. As a result, the left side guide 80-1 is unlocked from the cassette frame 71 and becomes slidable in both directions of arrow E. With this operation, the restriction surface of the left side guide 80-1 becomes operable in the sheet width direction. At the boundary between the lock layer 82 and claw part 83, a recess 821 is formed in order to enhance the flexibility of the boundary. Due to the recess, the claw part 83 is able to make straight movements (up with arrow D in FIG. 5B, or down with arrow B in FIG. 5A) regardless of rotational movement (arrows A and C) of the lock lever 82.

Therefore, the right side guide 80-2, which cooperates with the left side guide 80-1 through the pinion gear 73, similarly becomes slidable. As a result, the restriction surface of the lefts side guide 80-1 and the restriction surface of the right side guide 80-2 become cooperable in the sheet width direction.

Figure 6A:
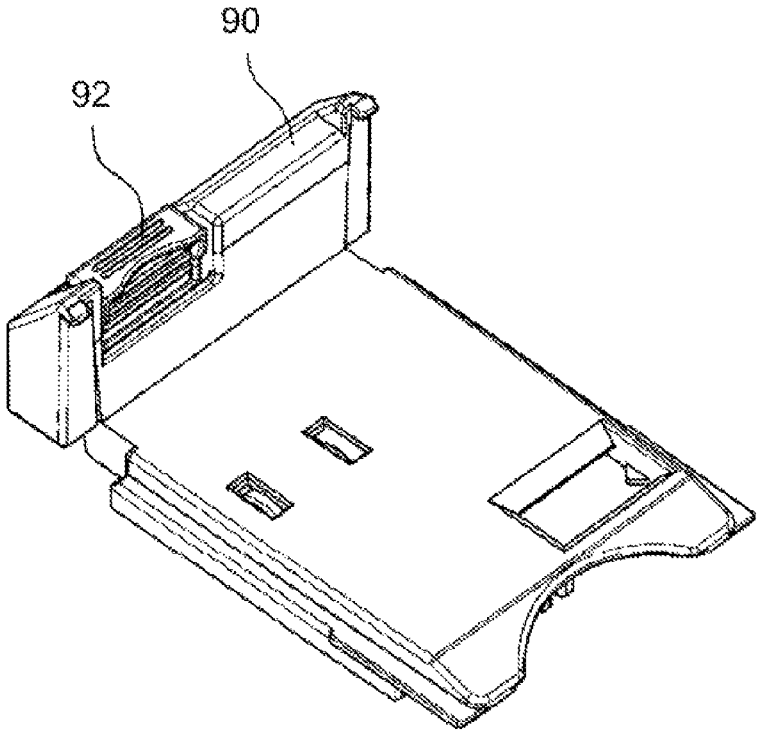
FIGS. 6A and 6B are perspective views of a tail guide in FIG. 2.
Figure 6B:
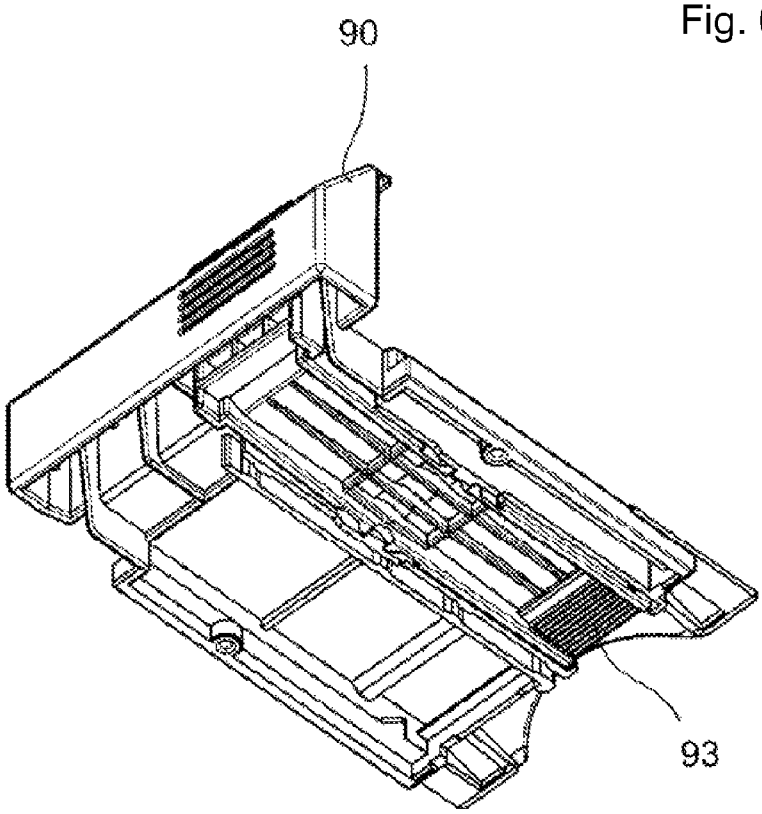

FIGS. 6A and 6B are perspective views of the tail guide shown in FIG. 2. FIG. 6A is a perspective view of the front side, and FIG. 6B is a perspective view of the back side.

The tail guide 90 includes a recording medium support part 901 provided in parallel with the sheet cassette 70 and a recording medium restriction part 902 provided perpendicular to a rear edge of the recording medium support part. Moreover, similar to the left side guide 80-1, the tail guide 90 includes the lock lever 92 and the claw part 93 that moves cooperably with the lock lever 92. The lock lever 92 is attached to a position from a rear edge of the recording medium restriction part of the tail guide 90 to a front back side 903 of the recording medium support part. As shown in FIG. 2, the claw part 93 engages with the groove 76 of the cassette frame 71. The claw part 93 is positioned on the front back side of the recording medium support part 93.

Figure 7A:
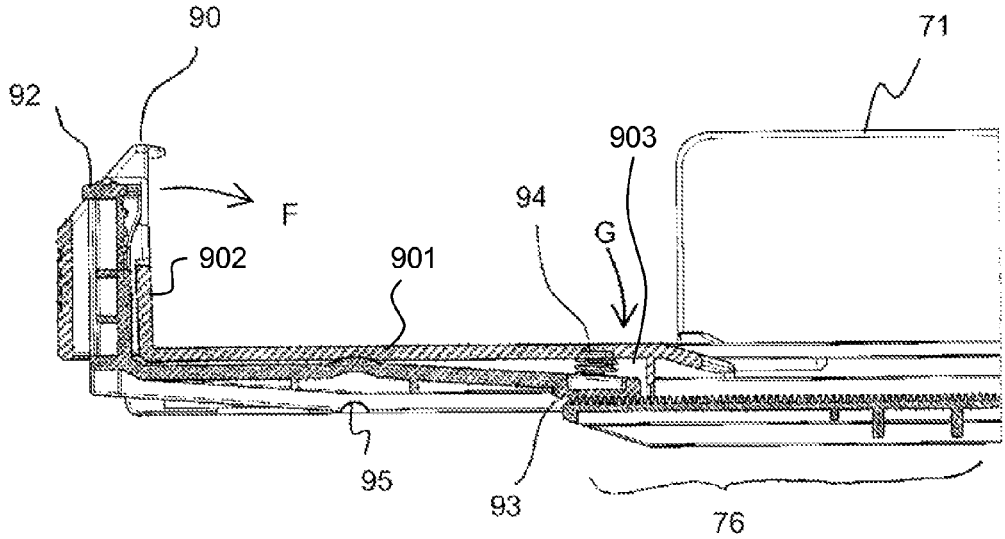
FIGS. 7A and 7B are cross-sectional views illustrating movement of the tail guide in FIG. 2.
Figure 7B:
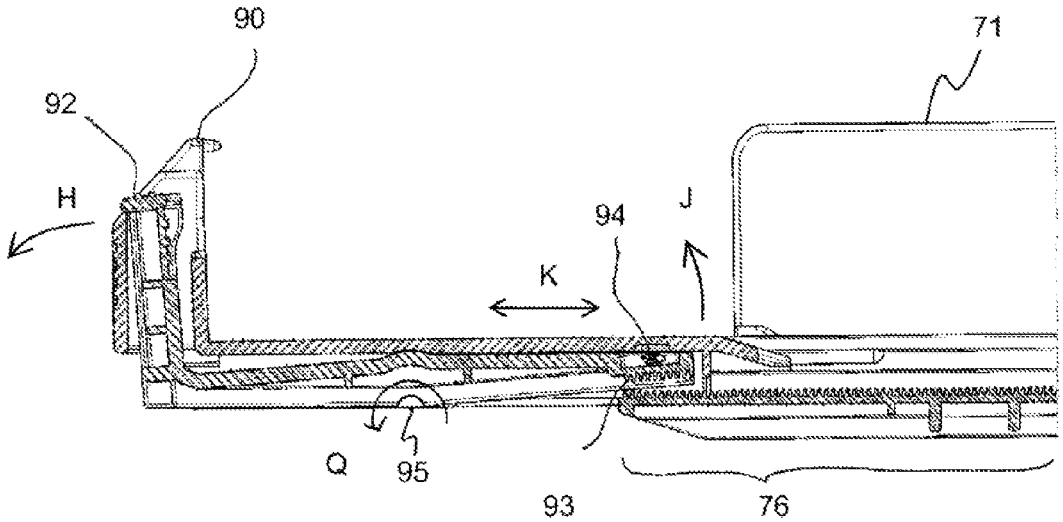

FIGS. 7A and 7B are cross-sectional views illustrating operation of the tail guide shown in FIG. 2. FIG. 7A illustrates the locked state, and FIG. 7B illustrates the unlocked state.

The tail guide 90 includes the lock lever 92 and the claw part 93 that are integrally formed, a coil spring 94 that is an elastic body, and a support point 95 that supports the lock lever 92 when the tail guide 90 is unlocked. The coil spring is arranged between the tail guide 90 and the lock lever 92, and just above the claw part 93. The coil spring continuously provides a bias (or an elastic force) downward in the figures. Not to mention, as long as to provide a proper bias with the lock lever, the position of the elastic body is a design matter by a skilled person.

As shown in FIG. 2 described above, the claw part 93 is a second engagement part and engages with the groove 76 (specifically, a linear gear arranged along the groove 76, or a first engagement part) of the cassette frame 71. The lock lever 92 is a lock member that is capable of locking the tail guide that is the guide member with the sheet cassette 70 that is the medium storage device and unlocking the lock to allow the tail guide 90 to extend or retract. At the bottom plane of the sheet cassette 70, the groove 76 is arranged along the insertion direction of the sheet cassette 70. The direction may be referred as a longitudinal direction of the sheet. In the groove 76, small projections are linearly arranged, see FIGS. 7A and 7B.

The lock lever 92 is slightly movable. Due to the movements, the lock lever 92 takes two different positions. One is a lock position. The other is an unlock position. In the embodiment, the lock lever 92 does a seesaw lock movement around the support point 95. As shown in FIG. 7A, the lock lever 92 is normally pushed in the direction of arrow G due to the load of the coil spring 94 that is the elastic body. At this time, the claw part 93 is engaged with the groove 76 of the cassette frame 71. Thereby, the lock lever 92 is prevented from traveling along the groove 76. As a result, the tail guide 90, which includes the lock lever 92, is locked on the cassette frame 71 (lock position). In addition, by pushing the lock lever 92 in the direction of allow F, the tail guide 90, which is the guide member, and the sheet cassette 70, which is the medium storage device, can be locked stably.

As shown in FIG. 7B, when the user moves the tail guide 90, the user moves the lock lever 92 in the direction of arrow H. The claw part 93 moves in the direction of arrow J at this time, and the engagement with the groove 76 is released (unlock position). As a result, the tail guide 90 is unlocked from the cassette frame 71 and becomes movable in both directions of arrow K. In such a state, the tail guide 90 can be extended or retracted in accordance with the size, or the rear edge part, of the recording sheet.

Figure 8:
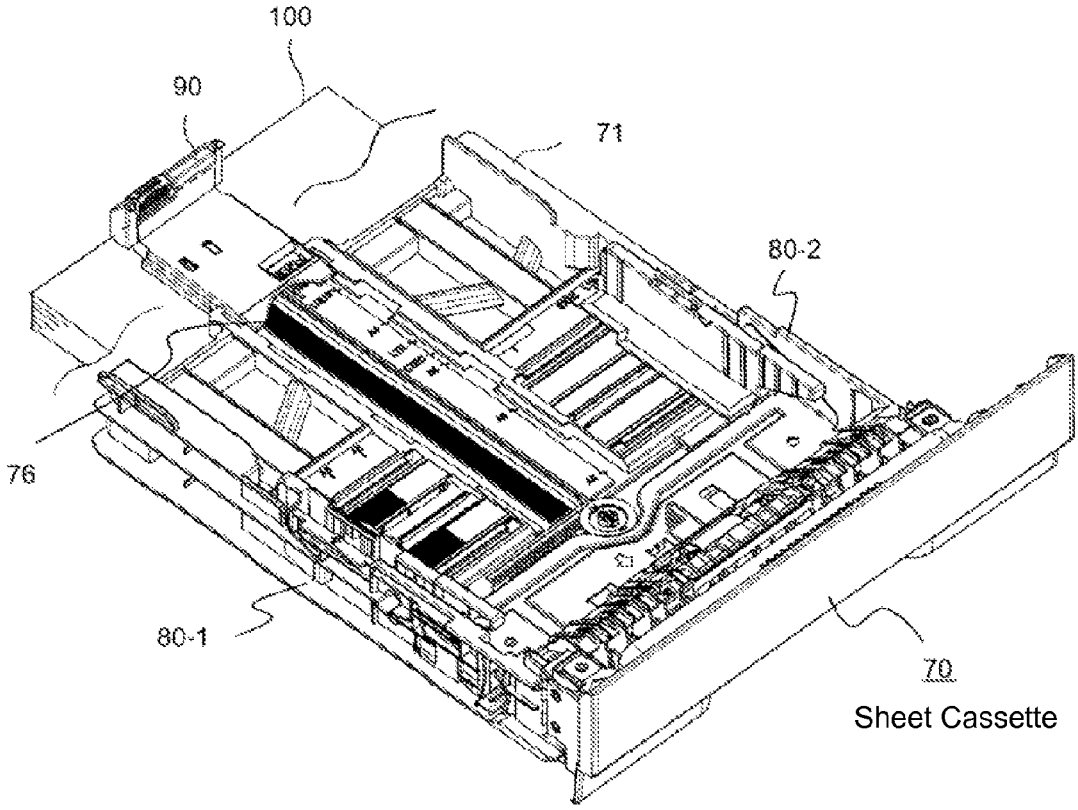
FIG. 8 is a perspective view illustrating a state in which recording sheets are loaded in the sheet cassette in FIG. 1.

FIG. 8 is a perspective view illustrating a state in which recording sheets are loaded in the sheet cassette in FIG. 1. FIG. 8 is a perspective view illustrating a state in which the recording sheets 100 having a larger size than the cassette frame 71. The tail guide 90 protects the rear edge of the recording sheets 100 by extending beyond the size of the cassette frame 71.

The tail guide 90 is fixed at a position protruding from the cassette frame 71. Therefore, when the sheet cassette 70, in which the tail guide 90 is fixed at the protruding position, is installed in the image forming device 10, the dust cover 60 slides from the inside of the image forming device 10 and covers the top surface and the rear surface of the sheet cassette 70 as shown in FIG. 3B.

Figure 9:
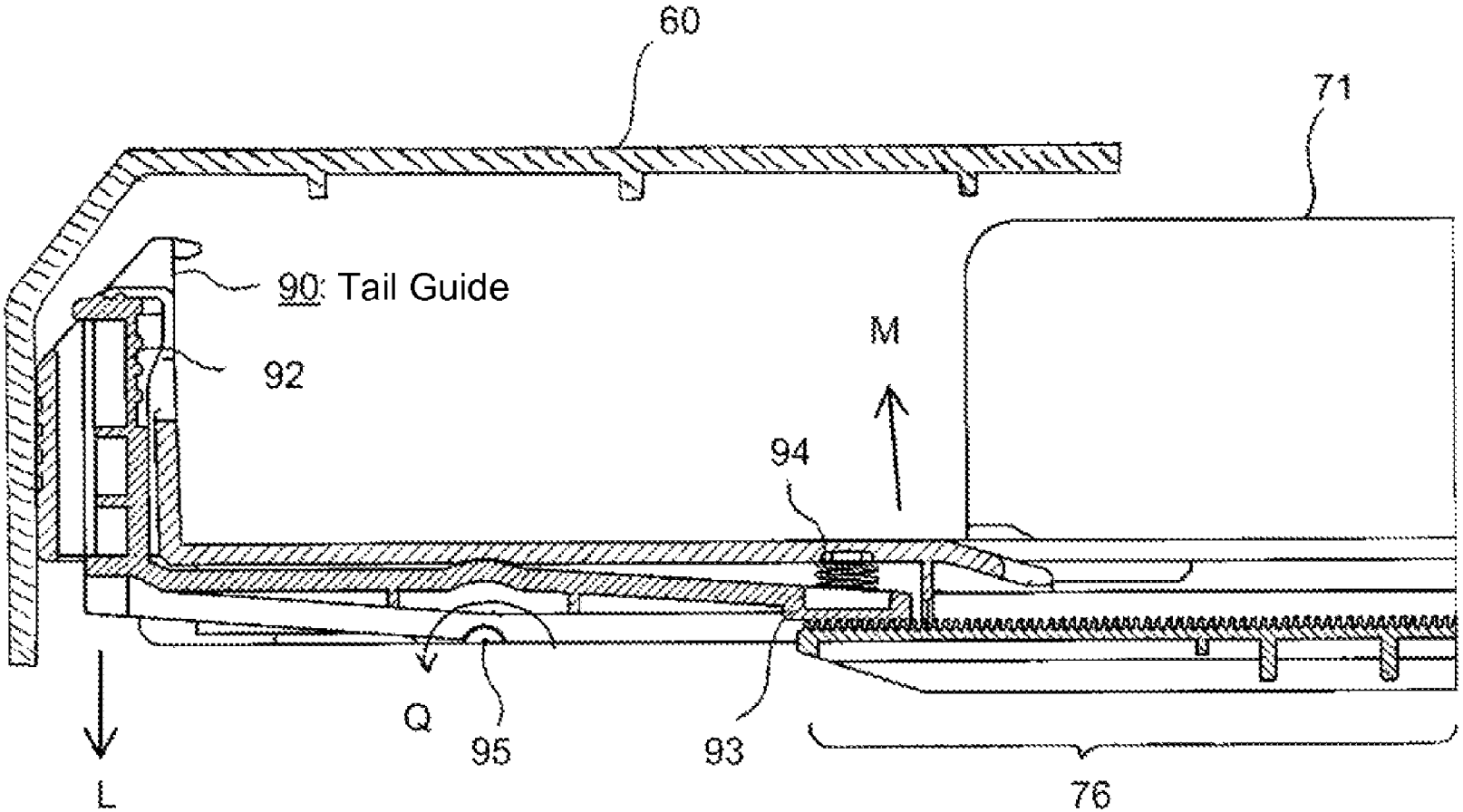
FIG. 9 is a cross-sectional view illustrating motion of the tail guide and a dust cover in a comparative example.
Figure 10:
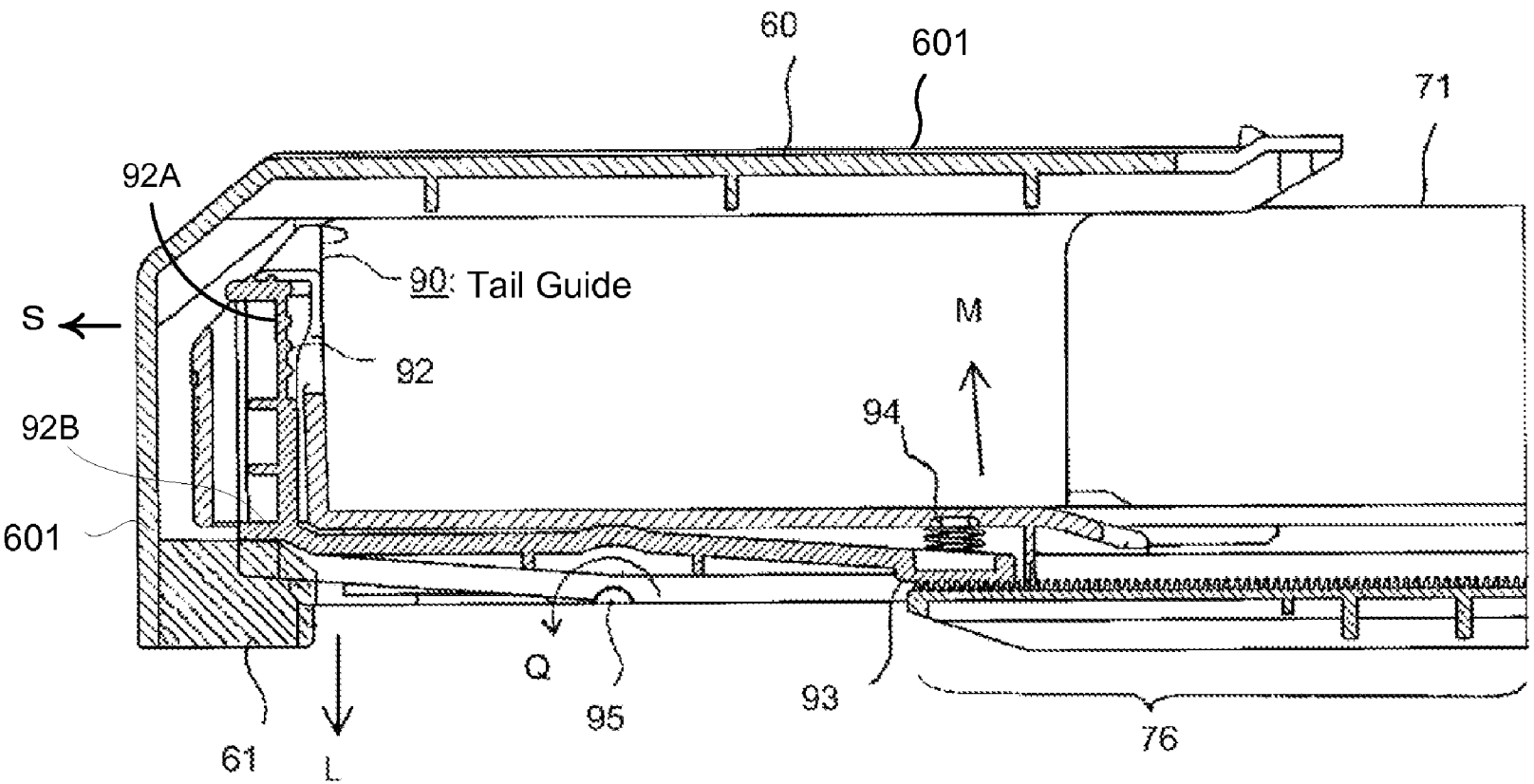
FIG. 10 is a cross-sectional view illustrating motion of the tail guide and a dust cover in the first embodiment of the present application.

The positional relationship between the tail guide 90 and the dust cover 60 at this time is illustrated in FIG. 9 and FIG. 10 that are described below.

FIG. 9 is a cross-sectional view illustrating motion of the tail guide and a dust cover in a comparative example. When the dust cover 60 is slid with contacting the rear edge of the tail guide 90, there is a case where the tail guide 90 inclines toward the direction of allow L because of the weight of the stored recording sheets or impact (vibration) generated at the time of a contact with the dust cover. This is because the tail guide 90 projects widely from the cassette frame 71.

When the tail guide 90 inclines to the direction of arrow L, the lock lever 92 rotates about the support point 95 in the direction of arrow Q. Then, a force acts in the direction of arrow M so that a force acts on the claw part 93 in a direction to disengage from the groove 76. When the sheet cassette 70 is installed to the image forming device 10 main body, the sheet cassette 70 contacts the dust cover 60, and the tail guide 90 is unlocked by the impact load and thus displaced.

FIG. 10 is a cross-sectional view illustrating motion of the tail guide and dust cover in the first embodiment of the present application.

The dust cover 60 of the first embodiment includes an abutment rib 61, which is an abutment member, at an inside lower part of the surface that covers the rear surface of the sheet cassette 70. The rib 61 restricts the inclination of the tail guide 90 in the direction of allow L and the rotation of the lock lever in the direction of arrow Q. With the restriction by the abutment rib 61, there is an effect that the tail guide 90 and the sheet cassette 70 are stably locked without the tail guide 90 being unlocked by the impact load even when the sheet cassette 70 is installed into the image forming device 10 main body and the dust cover 60 contacts the tail guide 90.

In addition, the position of the abutment rib 61 is not limited to the inside lower part of the surface of the dust cover 60 that covers the rear surface of the sheet cassette 70. However, the abutment rib 61 may be provided at any position of the inside of the surface of the dust cover 60 that covers the rear surface of the sheet cassette 70 as long as the abutment rib 61 restricts the inclination of the tail guide 90 in the direction of arrow L and the rotation of the lock lever in the direction of arrow Q. For example, in FIG. 10, a projection part that extends from the inside upper part of the surface of the dust cover 60 that covers the rear surface of the sheet cassette 70 may be provided so as to contact a bottom surface of a grip 92A of the lock lever 92, thereby the inclination of the tail guide 90 in the direction of arrow L is restricted.

The sheet cassette 70, which is the medium storage device, includes the tail guide 90, which is a guide member, that is provided extendably and retractably at the sheet cassette 70 and that restricts the position of the edge part of the recording sheets 100, and the lock lever 92, which is a lock member, that allows the tail guide 90 to extend and retract by locking the tail guide 90 and the sheet cassette 70 and unlocking the lock by moving in the direction of arrow L, which is a first direction. By restricting the movement of the lock lever 92 in the direction of arrow L, the tail guide 90 and the sheet cassette 70 are stably locked.

The dust cover 60 causes the tail guide 90 and the sheet cassette 70 to stably lock with each other as the abutment rib 61, which is the abutment member, abuts with the lock lever 92, which is the lock member, and restricts the movement of the lock lever 92 in the direction of arrow L when the sheet cassette 70, which is the medium storage device, is installed. That is, the dust cover 60 restricts the movement of the lock lever 92 in the direction of allow L so that the tail guide 90 is stably locked.

The dust cover 60 causes the claw part 93 of the lock lever 92 to engage with the groove 76 of the sheet cassette 70 and causes the lock lever 92 and the sheet cassette 70 to stably lock with each other, as the abutment rib 61 engages with the lock lever 92 and restricts the movement of the lock lever 92 in the downward direction when a force in the direction in which the dust cover 60 retracts, which is a second direction different from the first direction with respect to the claw part 93, is added to the dust cover 60. The first direction is a downward direction. The second direction is a retraction direction of the dust cover 60.

Figure 11A:
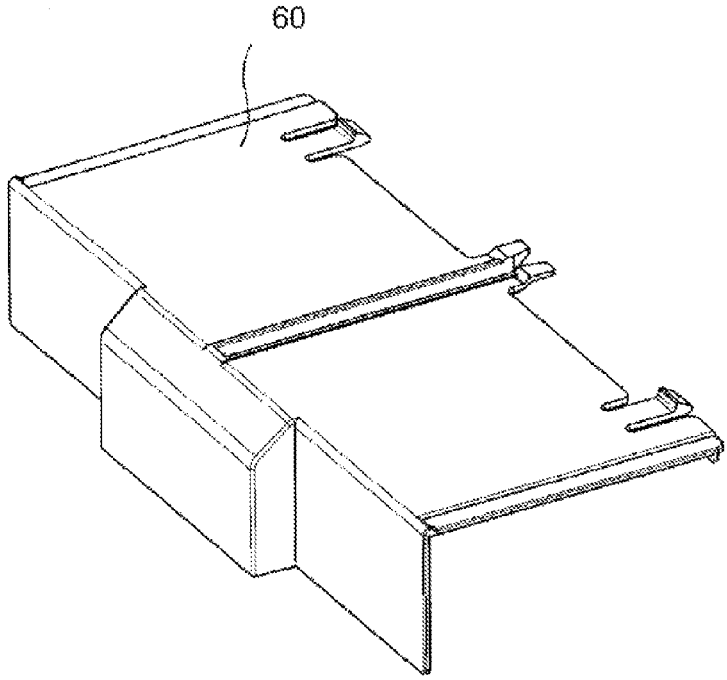
FIGS. 11A and 11B are perspective views of the dust cover in the first embodiment of the present application.
Figure 11B:
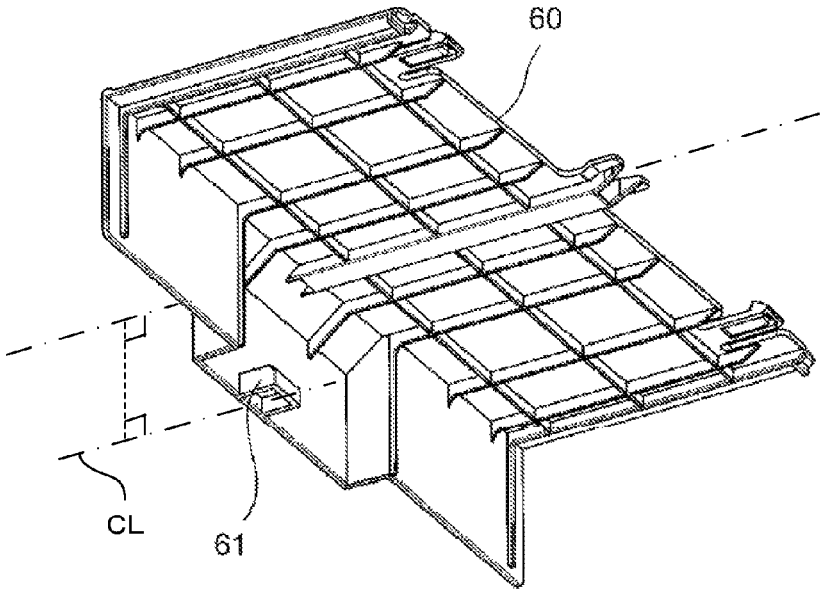

FIGS. 11A and 11B are perspective views of the dust cover in the first embodiment of the present application. FIG. 11A is a perspective view of the front side, and FIG. 11B is a perspective view of the back side.

The dust cover 60 includes a surface that covers the upper surface of the sheet cassette 70, which is the medium storage device, and a surface that covers the rear surface of the sheet cassette 70. The dust cover 60 includes the abutment rib 61, which is the abutment member. The abutment rib 61 is installed in the inside lower part of the surface that covers the rear surface of the sheet cassette 70.

In addition, in FIG. 11B, the abutment rib 61 is provided on a center line CL of the dust cover 60 with respect to the width direction. However, the abutment rib 61 may be provided at any position of the dust cover 60 in the width direction as long as the position corresponds to the position of the tail guide 90 of the sheet cassette 70. The center line CL is the same direction as the insertion direction of the sheet cassette.

Figure 12:
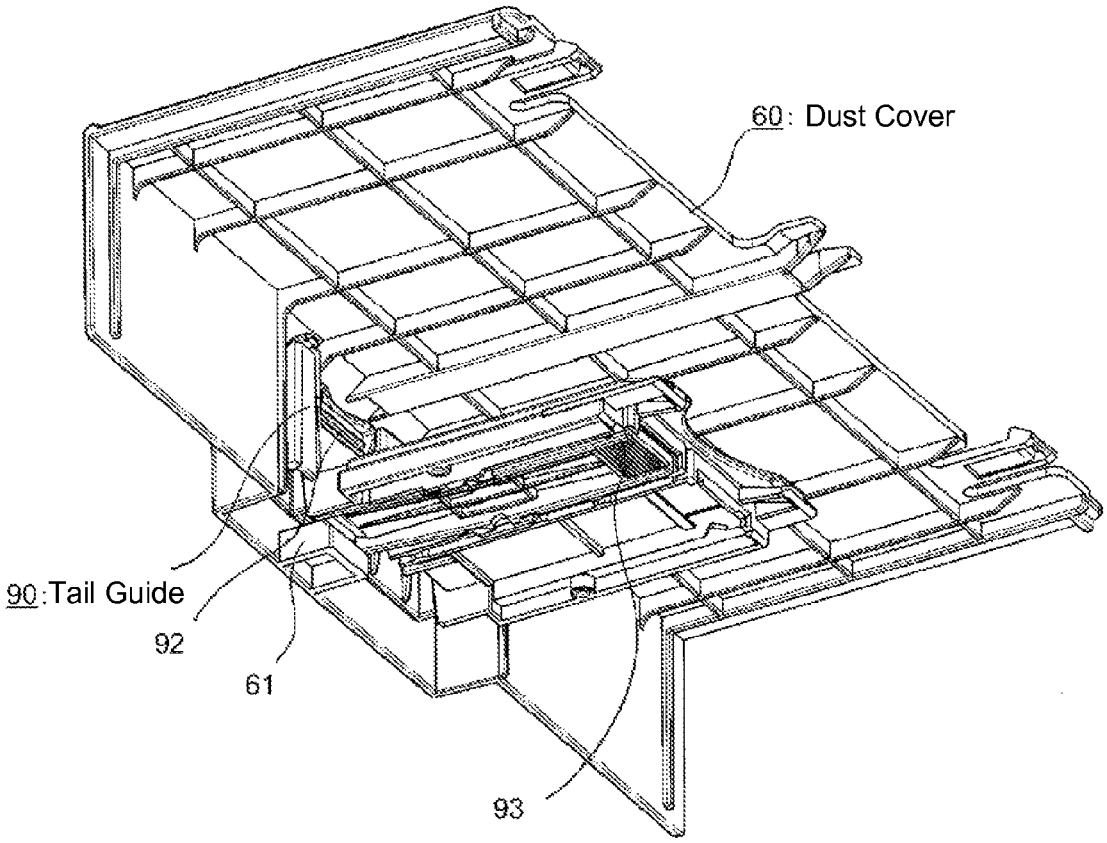
FIG. 12 is a perspective view illustrating a configuration of the dust cover and the tail guide in the first embodiment of the present application.

FIG. 12 is a perspective view illustrating a configuration of the dust cover and the tail guide in the first embodiment of the present application.

FIG. 12 is a perspective view illustrating a state in which the dust cover 60 is installed with the tail guide 90. As shown in FIG. 10 as well, as the abutment rib 61 provided in the dust cover 60 abuts with the lock lever 92, there is no space for the rock lever 92 moving downward so that the downward movement of the lock lever 92 is restricted. Therefore, there is no lifting of the claw part 93. With the structure, the movement in a direction, in which the engagement of the claw part 93 and the groove 76 is to be released, is restricted; the lock of the tail guide 90 becomes difficult to be unlocked. Note, when the moving direction of the lock lever 92 due to the bias provided from the coil spring 94, which is the elastic body, is defined as a first direction. The abutment rib 61 functions not to move the lock lever 92 in the first direction. In FIG. 10, the directions M, Q, L, and S are opposite to the first direction. For example, the direction M is an opposite direction from the first direction with respect to the claw part 93. The direction S is an opposite direction from the first direction with respect to the grip 92A. The direction L is an opposite direction from the thirst direction with respect to a bottom part 92B of the grip 92A. FIG. 10 illustrates that the abutment rib 61 resides beneath the bottom part 92B so as to prevent the lock lever 92 from moving in the first direction.

The displacement of the tail guide 90 due to unlocking is prevented by the dust cover 60 and the sheet cassette 70 of the first embodiment, thereby preventing scratches and folds of the edge parts of the recording sheets 100. In addition, jams during the sheet carrying are reduced, thereby allowing stable image forming operations.

(Effects of First Embodiment) According to the medium storage device, dust cover and image forming device of the present application of the first embodiment, there are the following advantages (A) and (B):

(A) The abutment rib 61 that restricts the inclination of the tail guide 90 is added to the inside lower part of the dust cover 60 that covers the rear surface of the sheet cassette 70. As a result, the displacement of the tail guide 90 due to the unlocking of the tail guide 90 that occurs at the time of installing the sheet cassette 70 is prevented, thereby preventing the scratches and folds that occur at edge parts of the recording sheets 100.

(B) In addition, jams at the time of carrying the sheets are reduced, and stable image forming operation becomes possible.

Figure 13:
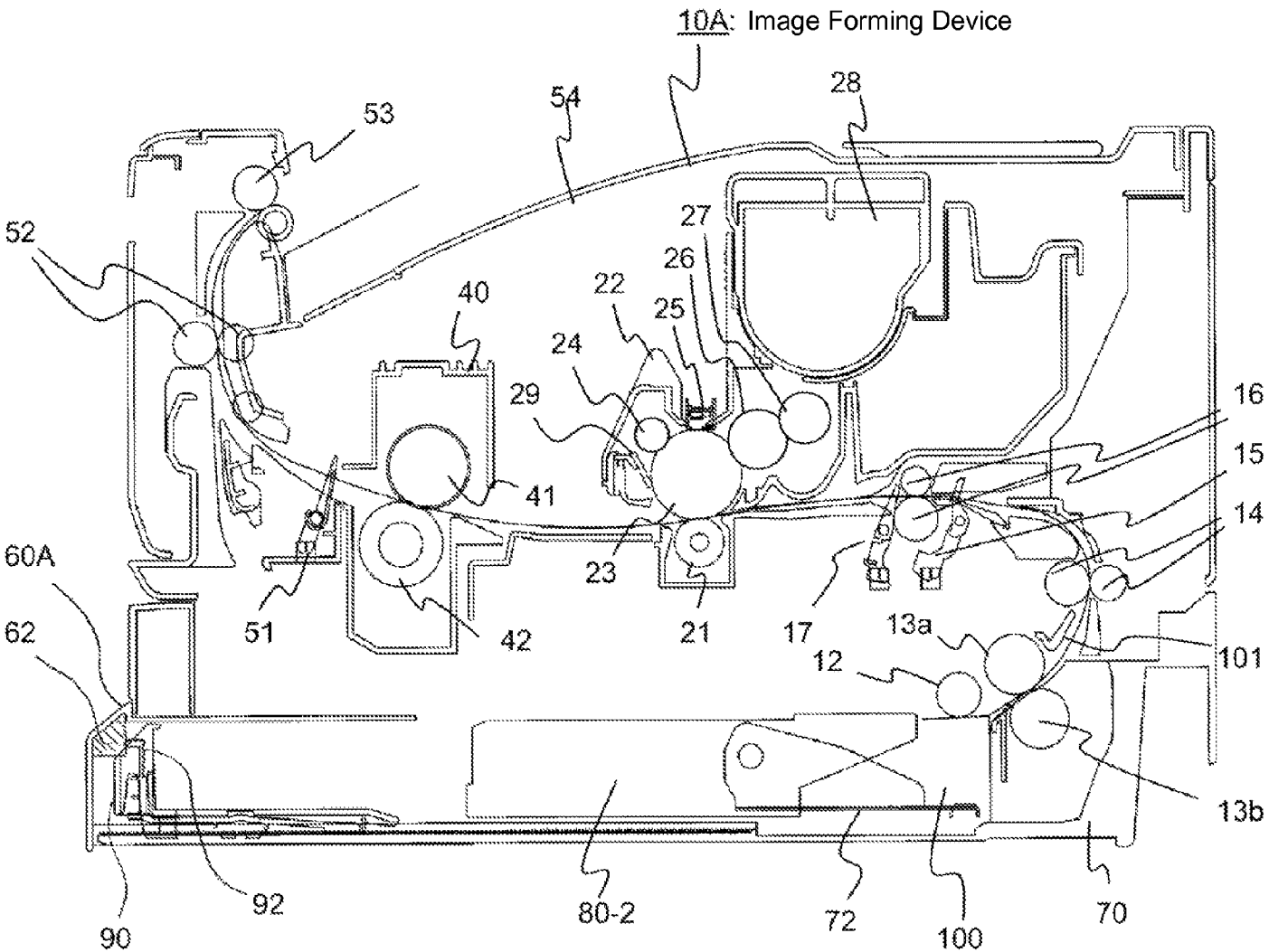
FIG. 13 is a schematic structural diagram illustrating an image forming device according to a second embodiment of the present application.

Second Embodiment (Configuration of Second Embodiment) FIG. 13 is a schematic structural diagram illustrating an image forming device according to a second embodiment of the present application. Elements that are common with the elements shown in FIG. 1 that illustrates the first embodiment are referred to by the same symbols.

An image forming device 10A of the present second embodiment includes a dust cover 60A that is different from that in the image forming device 10 of the first embodiment. The dust cover 60 of the first embodiment is provided with the abutment rib 61 that engages with the tail guide 90, in the inside lower part of the surface that covers the rear surface of the sheet cassette 70. The dust cover 60A of the second embodiment is provided with an abutment rib 62 that engages with the tail guide 90, in the inside upper part of the surface that covers the rear surface of the sheet cassette 70, so that the abutment rib 62 is configured to engage with the lock lever 90 of the tail guide 90. Except the dust cover 60A, the image forming device 10A and the sheet cassette 70 includes the configurations similar to the image forming device 10 and the sheet cassette 70 of the first embodiment.

(Operation of Second Embodiment) The image forming operation is the same as the first embodiment, and therefore, the explanation thereof is omitted. The sheet supply operation for the recording sheets 100 in the sheet cassette 70 and the operations of the left side guide 80-1, right side guide 80-2 and tail guide 90 are also the same as the first embodiment. Therefore, the explanations are omitted.

Figure 14:
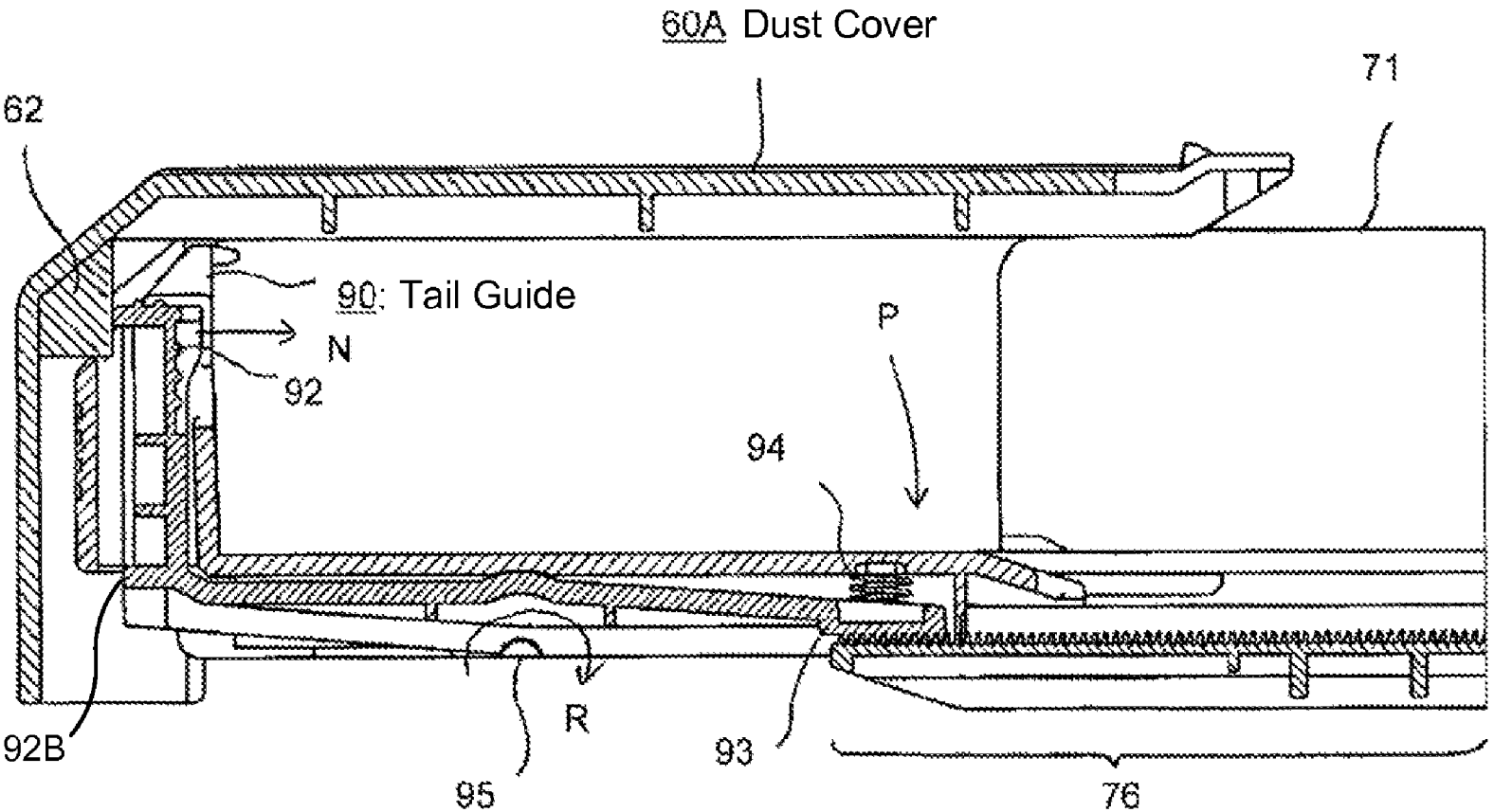
FIG. 14 is a cross-sectional view illustrating movement of the dust cover and the tail guide in the second embodiment of the present application.

FIG. 14 is a cross-sectional view illustrating movement of the dust cover and the tail guide in the second embodiment of the present application.

In the second embodiment, the dust cover 60A includes a surface that covers the top surface of the sheet cassette 70, which is the medium storage device, and a surface that covers the rear surface. The abutment rib 62, which is the abutment member, is installed in the inner upper part of the surface that covers the rear surface of the sheet cassette 70. The abutment rib 62 abuts with the lock lever 92 of the tail guide 90.

When the sheet cassette 70 is installed, the lock lever 92 is always pushed by the abutment rib 62 of the dust cover 60A in the direction of arrow N, which is a third direction perpendicular to the first direction. The third direction is an insertion direction of the sheet cassette 70, which is the medium storage device. A force in the direction of arrow R is applied at the support point 95, and therefore, a force in the direction of arrow P is applied at the claw part 93. As a result, the claw part 93 of the lock lever 92 and the groove 76 of the cassette frame 71 are more stably engaged than the first embodiment, thereby preventing the tail guide 90 from being displaced.

In addition, the position of the abutment rib 62 is not limited to the inside upper part of the surface of the dust cover 60A that covers the rear surface of the sheet cassette 70. However, the abutment rib 62 may be provided at any position of the inside of the surface of the dust cover 60A that covers the rear surface of the sheet cassette 70 as long as the abutment rib 62 restricts the inclination of the tail guide 90 in the direction of arrow N. For example, in FIG. 14, a projection part that extends from the inside lower part of the surface of the dust cover 60A that covers the rear surface of the sheet cassette 70 may be provided so as to press a lower edge part 92B of the lock lever 92, thereby the tail guide 90 is always pushed in the direction of arrow N is restricted.

Figure 15A:
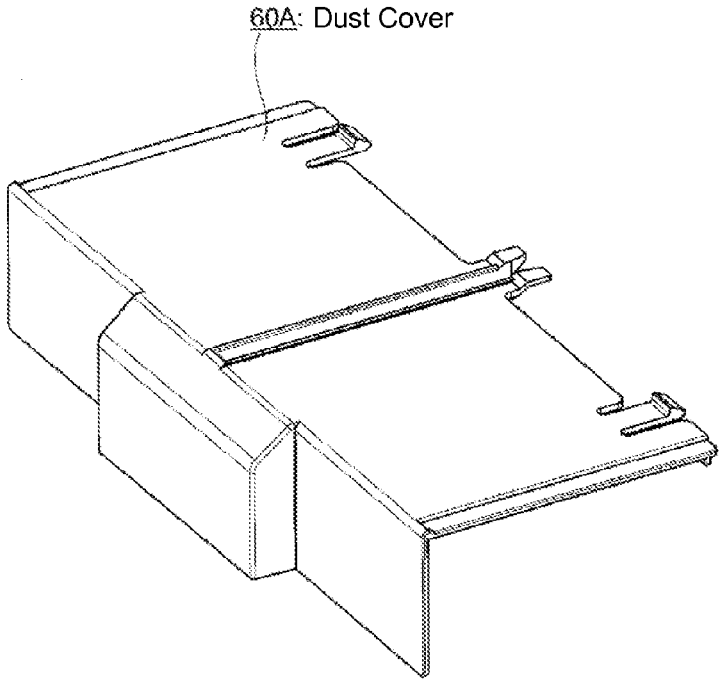
FIGS. 15A and 15B are perspective views of the dust cover in the second embodiment of the present application.
Figure 15B:
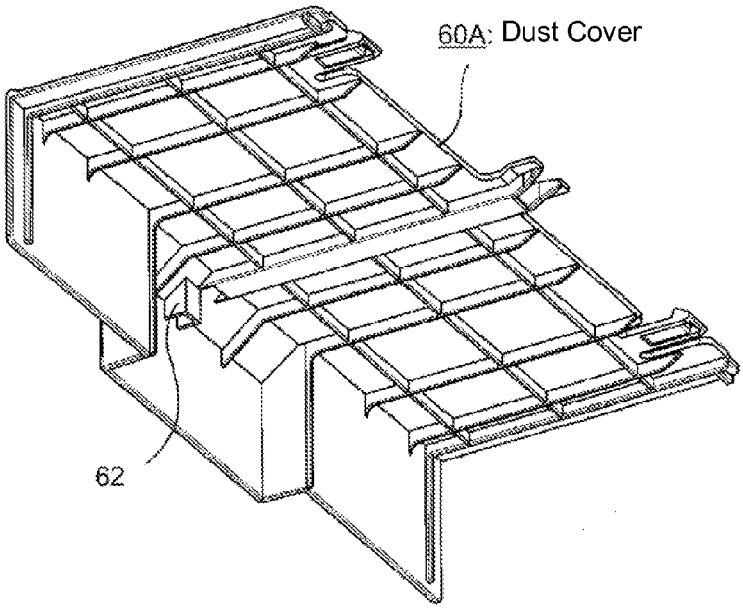

FIGS. 15A and 15B are perspective views of the dust cover in the second embodiment of the present application. FIG. 15A is a perspective view of the front side, and FIG. 15B is a perspective view of the back side.

As shown in FIG. 15A, the perspective view of the front side of the dust cover 60A of the second embodiment is similar to the perspective view of the front side of the dust cover 60 of the first embodiment as shown in FIG. 11A.

As shown in FIG. 15B, the perspective view of the back side of the dust cover 60A of the second embodiment is different from that of the dust cover 60 of the first embodiment shown in FIG. 11B in that the abutment rib 62 is provided at the inside upper part of the surface that covers the rear surface of the sheet cassette 70.

In addition, in FIG. 15B, the abutment rib 62 is provided in a center of the dust cover 60A in the width direction (direction perpendicular to the retraction direction of the dust cover 60A). However, the abutment rib 62 may be provided at any position of the dust cover 60A in the width direction as long as the position corresponds to the position of the tail guide 90 of the sheet cassette 70.

FIG. 26 is a perspective view illustrating the dust cover and the tail guide in the first embodiment of the present application.

Figure 16:
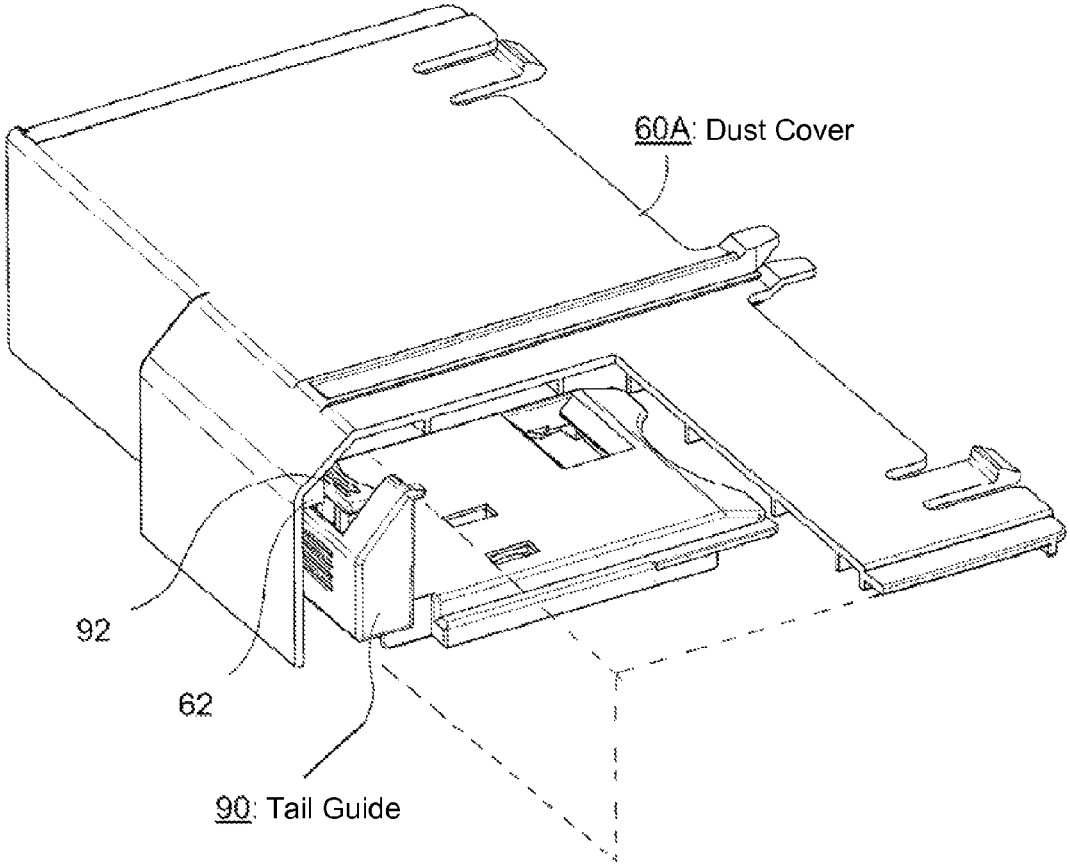
FIG. 16 is a perspective view illustrating the dust cover and the tail guide in the second embodiment of the present application.

When the sheet cassette 70 (not shown in FIG. 16) is installed, the sheet cassette 70 and the tail guide 90 that the sheet cassette 70 includes slide in the direction to the left side of the drawing. At this time, the lock lever 92 of the tail guide 90 engages with the abutment rib 62 of the dust cover 60A and receives a force in the direction to the right side, which is an inward direction. By this force, the claw part 93 of the lock lever 92 and the groove 76 of the cassette frame 71 engage more stably than the first embodiment. Therefore, the tail guide 90 is prevented from being displaced.

As a result, the impact load by the dust cover 60A that occurs when the sheet cassette 70 is installed can be converted into the locking force of the tail guide 90, and thereby the displacement of the tail guide 90 is prevented. Accordingly, the scratches and folds that occur at the edge parts of the recording sheets 100 are prevented. As a result, jams at the time of carrying the sheets are reduced, resulting in the stable image forming operations.

(Effects of Second Embodiment) According to the medium storage device, dust cover and image forming device of the second embodiment, The abutment rib 62 is added to the inside upper part of a surface of the dust cover 60A that covers the rear surface of the sheet cassette 70 and is configured to contact the upper part of the lock lever 92 of the tail guide 90. As a result, the impact load by the dust cover 60A that occurs when the sheet cassette 70 is installed can be converted into the locking force of the tail guide 90, and thereby there is an effect that the displacement of the tail guide 90 is prevented by a stronger force.

(Exemplary Modification) The above-described embodiments are not limited to the above-described configurations, and other various forms and modifications are possible. The following (a) to (d) are examples of such forms and exemplary modifications.

(a) In the first and second embodiments, the image forming devices 10 and 10A, which are electrographic printers, are explained as examples. However, the configurations are not limited to those and may be applicable to multi function peripherals (MFP) that has multifunction's including a facsimile function, a photocopy function, a printing function and the like, facsimile devices, photocopy machines and the like.

(b) In the first and second embodiments, a single tray sheet cassette 70 is described as an example for the medium storage device that is installed in the image forming devices 10 and 10A. However, the configurations are not limited to that and may be applicable to dual tray or triple tray sheet cassettes, dust cover and the image forming device into which the sheet cassette is installed.

(c) In the first embodiment, the medium storage device is explained as an example that releases the lock of the sheet cassette 70 and the tail guide 90 by the downward movement of the lock lever 92. However, the configurations are not limited to that and may be applicable to a medium storage device in which the sheet cassette 70 and the tail guide 90 are unlocked by the upward movement of the lock lever 92, a dust cover and an image forming device therefor. In that case, the abutment member of the first embodiment may be provided at the inside upper part of the surface of the dust cover that covers the rear surface of the medium storage device.

(d) Similar to the first embodiment, in the second embodiment, the medium storage device is explained as an example that releases lock of the sheet cassette 70 and the tail guide 90 by the downward movement of the lock lever 92. However, the configurations are not limited to that and may be applicable to a medium storage device in which the sheet cassette 70 and the tail guide 90 are unlocked by the upward movement of the lock lever 92, a dust cover and an image forming device therefor. In that case, the abutment member of the second embodiment may be provided at the inside lower part of the surface of the dust cover that covers the rear surface of the medium storage device.

(e) In the first embodiment, the first engagement part is the groove, and the second engagement part is the claw part. The guide member is stably locked as the second engagement part engages with the first engagement part. However, the configurations are not limited to this. The first engagement part may be the claw part, and the second engagement part may be the groove. The guide member may be stably locked as the second engagement part engages with the first engagement part.

Of course, the abutment member of the first embodiment and the abutment member of the second embodiment may be both provided on the dust cover. In that case, the abutment member of the first embodiment and the abutment member of the second embodiment may be provided separately or in a form of an integrally formed L-shaped engagement member, for example.

What is claimed is:

1. A medium storage device that is covered by a dust cover and that stores a recording medium, comprising:

a slidably extendable and retractable guide member that is provided in the medium storage device and that restricts a position of an edge part of the recording medium; and a lock member that locks the guide member and that releases the lock status of the guide member when the lock member moves in a first direction so as to allow the guide member to slidably extend and retract, wherein the movement of the lock member in the first direction is restricted by the dust cover so that the guide member is stably locked.

2. The medium storage device of claim 1, further comprising:

a first engagement part, wherein the guide member is provided extendably and retractably at a rear edge of the medium storage device and restricts the position of the rear edge part of the recording medium, the lock member includes a second engagement part, and the movement of the lock member in the first direction is restricted by the dust cover so that the second engagement part of the lock member engages with the first engagement part of the medium storage device, and thereby the guide member is stably locked.

3. The medium storage device of claim 2, further comprising:

an elastic body, wherein the elastic body is arranged in order to bias the second engagement part of the lock member in a direction towards the first engagement part of the medium storage device so that the guide member is locked.

4. The medium storage device of claim 1, wherein the dust cover covers the medium storage device and includes an abutment member that abuts with the lock member, and when the abutment member abuts with the lock member at the time of installing the medium storage device and when a force in a second direction that is different from the first direction with respect to the second engagement part is applied to the dust cover, the guide member is stably locked as the movement of the lock member in the first direction is restricted by the abutment member.

5. The medium storage device of claim 4, wherein the first direction with respect to the second engagement part of the lock member is downward, and the second direction is a retraction direction of the guide member.

6. The medium storage device of claim 5, wherein the dust cover includes at least a first surface part that covers a top surface of the medium storage device and a second surface part that covers a rear surface of the medium storage device, and the abutment member is installed in an inside lower part of the second surface part.

7. The medium storage device of claim 1, wherein the dust cover covers the medium storage device and includes an abutment member that abuts with the lock member, and the abutment member abuts with the lock member at the time of installing the medium storage device, and the abutment member presses the lock member in a third direction perpendicular to the first direction with respect to the second engagement part so that the guide member is stably locked.

8. The medium storage device of claim 7, wherein the third direction is a retraction direction of the guide member.

9. The medium storage device of claim 8, wherein the dust cover includes at least a first surface part that covers a top surface of the medium storage device and a second surface part that covers a rear surface of the medium storage device, and the abutment member is installed in an inside of the second surface.

10. An image forming device including the dust cover and the medium storage device of claim 1.

11. The medium storage device of claim 1, further comprising:

a groove that is formed on a surface of the medium storage device and that extends in a direction of the extension and retraction of the guide member, wherein the guide member extends and retracts along the groove.

12. The medium storage device of claim 1, wherein the dust cover is slidable with the guide member.

13. A medium storage system, comprising:

a medium storage device that stores a recording medium, the medium storage device including a guide member that is slidably extendable and retractable in accordance with the size of the recording medium, and that guides a longitudinal edge part of the recording medium, and a lock member that moves together with the guide member, and that is slightly movable in order to take two positions: one for locking the guide member, the other for unlocking the guide member; and a dust cover that is attached to the guide member in order to move together with the guide member and that covers a top surface of the medium storage device, the dust cover including an abutment member that abuts with the lock member such that the position of the lock member remains locked while the dust cover is attached.

14. The medium storage system of claim 13, wherein the medium storage device includes an elastic body that continuously provide an elastic force to one end of the lock member such that the lock member is moved in a first direction, the dust cover is formed with a top surface part and a rear surface part that is positioned at a distal end of the top surface part, the top surface part covering the top surface of the recording medium and the rear surface part covering the rear surface of recording medium, the abutment member is arranged at an inside of the rear surface part so as to prevent the lock member from moving in the first direction.

15. The medium storage system of claim 14, wherein the abutment member is provided on a center line of the dust cover with respect to its width direction.

16. The medium storage device of claim 13, wherein the medium storage device further includes:

a groove that is formed on a surface of the medium storage device and that extends in a direction of the extension and retraction of the guide member, wherein the guide member extends and retracts along the groove.

17. A medium storage device that is covered by a dust cover and that stores a recording medium, comprising:

a guide member that is extendably and retractably provided in the medium storage device and that restricts a position of an edge part of the recording medium; and a lock member that locks the guide member and that releases the lock status of the guide member when the lock member moves in a first direction so as to allow the guide member to extend and retract, wherein the movement of the lock member in the first direction is restricted by the dust cover so that the guide member is stably locked, the dust cover covers the medium storage device and includes an abutment member that abuts with the lock member, the abutment member abuts with the lock member at the time of installing the medium storage device, and the abutment member presses the lock member in a third direction perpendicular to the first direction with respect to the second engagement part so that the guide member is stably locked, and the third direction is a retraction direction of the guide member.

18. A medium storage system, comprising:

a medium storage device that stores a recording medium, the medium storage device including a guide member that is extendable and retractable in accordance with the size of the recording medium, and that guides a longitudinal edge part of the recording medium, and a lock member that moves together with the guide member, and that is slightly movable in order to take two positions: one for locking the guide member, the other for unlocking the guide member; and a dust cover that is attached to the guide member in order to move together with the guide member and that covers a top surface of the medium storage device, the dust cover including an abutment member that abuts with the lock member such that the position of the lock member remains locked while the dust cover is attached, wherein the medium storage device includes an elastic body that continuously provide an elastic force to one end of the lock member such that the lock member is moved in a first direction, the dust cover is formed with a top surface part and a rear surface part that is positioned at a distal end of the top surface part, the top surface part covering the top surface of the recording medium and the rear surface part covering the rear surface of recording medium, and the abutment member is arranged at an inside of the rear surface part so as to prevent the lock member from moving in the first direction.

* * * * *